US006125253A

United States Patent [19]

Tashima et al.

[11] Patent Number: 6,125,253

[45] Date of Patent: Sep. 26, 2000

[54] IMAGE FORMING APPARATUS HAVING DRIVE MECHANISM FOR PHOTOSENSITIVE DRUM AND DEVELOPING ROLLER

[75] Inventors: Kazuhiko Tashima, Chikushino; Yuzo Kawano, Ogori; Yoshiaki Ijima, Dazaifu; Tetsuo Korenaga, Tosu, all of Japan

[73] Assignee: Matsushita Electric Industrial Co., Ltd., Osaka, Japan

[21] Appl. No.: 09/327,955

[22] Filed: Jun. 8, 1999

[30] Foreign Application Priority Data

Jun. 26, 1998 [JP] Japan ..... 10-180267

[51] Int. Cl.[7] ..... G03G 15/00

[52] U.S. Cl. ..... 399/167; 399/265

[58] Field of Search ..... 399/167, 222, 399/116, 117, 119, 159, 265; 74/665 GE

[56] References Cited

U.S. PATENT DOCUMENTS 5,319,418 6/1994 Fujimoto et al. ..... 399/167
5,528,343 6/1996 Tada et al. ..... 399/113
5,768,656 6/1998 Nagasue et al. ..... 399/75
5,950,048 9/1999 Okumura et al. ..... 399/113

FOREIGN PATENT DOCUMENTS 60-083973 5/1985 Japan .
60-091372 5/1985 Japan .
7-160147 6/1995 Japan .
9114160 5/1997 Japan .

*Primary Examiner*—Robert Beatty
*Attorney, Agent, or Firm*—Stevens, Davis, Miller & Mosher, L.L.P.

[57] ABSTRACT

A motor pulley for driving a photosensitive drum and a motor gear for driving a developing roller are fixed to a rotating shaft of a motor. The developing roller is provided with a developing roller driving gear which engages with the motor gear, and the photosensitive roller is provided with a photoreceptor driving pulley, to which a driving force from the motor pulley is transmitted.

4 Claims, 5 Drawing Sheets

IMAGE FORMING APPARATUS HAVING DRIVE MECHANISM FOR PHOTOSENSITIVE DRUM AND DEVELOPING ROLLER

BACKGROUND OF THE INVENTION

1. Field of the Invention

The present invention relates to an image forming apparatus performing image formation in electrophotography.

2. Description of the Prior Art

Conventionally, a photosensitive drum serving as an image carrying body, and a developing roller for developing an electrostatic latent image formed on the photosensitive roller are used in an image forming unit of an image forming apparatus making use of electrophotography and typified by printers, facsimiles and copy machines. In particular, in recent years, it becomes further important to accurately perform drive transmission of the photosensitive drum and developing roller so as to eliminate variations in speed, such as rotational fluctuation in order to obtain a stable image since output for color printing necessitates accurate color registration of toner images in respective colors.

Here, one of the causes for uneven rotational driving is resulted from a gap between gears engaging with each other. A gap (backlash) being formed between gears engaging with each other to make engaging-motion smooth, such cause is based on the fact that in the event of a change in drive transmission torque and a rapid change in rotational speed of a motor, tooth faces in meshing contact with each other to effect drive transmission separate from each other temporarily in the space of backlash to cause drive transmission to be suspended temporarily, with the result that rotational transmission speed intermittently fluctuates. This fluctuation leads to uneven rotation.

Therefore, in order to reduce such uneven rotation, it is important not to use more gears, which are drive transmission means, than necessary. Furthermore, it is particularly essential not to use any intermediate gear or gears serving only as occupying distances between shafts.

With an image forming apparatus, when uneven rotation arises in a drive transmission system, contraction and elongation generates in pitches in a paper feed direction, and in particular, with an image forming apparatus for color printing, color slurring generates to deteriorate color reproducibility.

Next, conventional drive transmission mechanisms for a photosensitive roller and a developing roller will be described.

Here, FIG. 4 is a perspective view showing an essential part of a conventional drive transmission mechanisms for a photosensitive roller and a developing roller. FIG. 5 is a front view showing the essential part of the conventional drive transmission mechanisms for the photosensitive roller and developing roller.

Drive transmission means consists of two systems of driving trains, that is, a train of drive transmission means called a developing roller driving train and comprising a developing roller driving motor 28, a developing roller 16, and drive transmission means such as several gears and pulleys, and a train of drive transmission means called a photosensitive roller driving train and including a photoreceptor driving motor 29 and a photosensitive roller 7.

As shown in the drawings, the developing roller driving motor 28 and photoreceptor driving motor 29 are mounted on a plate 27. A rotating shaft of the developing roller driving motor 28 extends through a hole formed in the plate 27, and securingly mounts a developing motor gear 32 to an end thereof. In addition, a developing roller driving gear 33 is rotatably mounted on the plate 27. Furthermore, an intermediate gear 35A is rotatably mounted on the plate 27 to engage with the developing motor gear 32 and the developing roller driving gear 33. In addition, the developing roller 16 for developing an electrostatic latent image on the photosensitive roller 7 is connected to the developing roller driving gear 33 through a transmission connecting device.

In addition, a rotating shaft of the photoreceptor driving motor 29 extends through a hole formed in the plate 27, and securingly mounts a photoreceptor motor gear 34A to an end thereof. Furthermore, a photoreceptor driving gear 36A is rotatably mounted on the plate 27. Moreover, an intermediate gear 35B is rotatably mounted on the plate 27 to engage with the photoreceptor motor gear 34A and photoreceptor driving gear 36A. In addition, the photosensitive roller 7 that is an image carrying body is connected to the photoreceptor driving gear 36A through a transmission connecting device.

In this construction, in order to miniaturize the image forming apparatus, the developing roller 16 and the photosensitive roller 7 are reduced in outer diameter, and the developing roller driving gear 33 and photoreceptor driving gear 36A are correspondingly reduced.

With the arrangement of the prior art described above, however, there is a limitation in arranging the two driving trains in the same plane with compactness, so that the developing roller driving train and photosensitive roller driving train are driven separately by the expensive motors 28 and 29 for the reason that it is not possible to arrange a shaft, which bears thereon a gear, on a rotating gear.

In this regard, due to the necessity for mounting the two motors in non-interfering positions, it is not possible to arrange the respective driving trains in positions which permit driving forces to be transmitted shortest distances from the motor shafts to the respective rollers 7 and 16, so that the driving forces must be transmitted from the motor shafts to the respective rollers via a roundabout way with the use of the intermediate gears 35A and 35B which are likely to cause uneven rotation.

In this manner, with the prior image forming apparatus, it is necessary to provide the motor 28 for driving the developing roller 16 and the motor 29 for driving the photosensitive roller 7, respectively, which leads to increased cost.

In addition, since the two motors 28 and 29 must be mounted in positions, where interfering therebetween is avoided, to drive the developing roller 16 and photosensitive roller 7, respectively, it is necessary to use the intermediate gears 35A and 35B that are likely to generate uneven rotation and are inferior in space efficiency.

SUMMARY OF THE INVENTION

An object of the present invention is to provide an image forming apparatus that can drive two rollers composed of a developing roller and a photosensitive roller with a single motor.

In addition, another object of the present invention is to provide an image forming apparatus that can drive two rollers composed of a developing roller and a photosensitive roller without the use of any intermediate gear while suppressing uneven rotation to the minimum.

To this end, an image forming apparatus according to the present invention comprising a motor for generating torque, a motor gear fixed to a rotating shaft of the motor, a drive transmission means fixed to the rotating shaft, a roller driving gear which engages with the motor gear and connects to a second roller, and a drive receiving member, to which torque is transmitted from the drive transmission means and which is connected to a first roller provided close to the second roller.

Thus, it becomes possible to drive the two rollers with the single motor.

DESCRIPTION OF THE PREFERRED EMBODIMENTS

Figure 2:
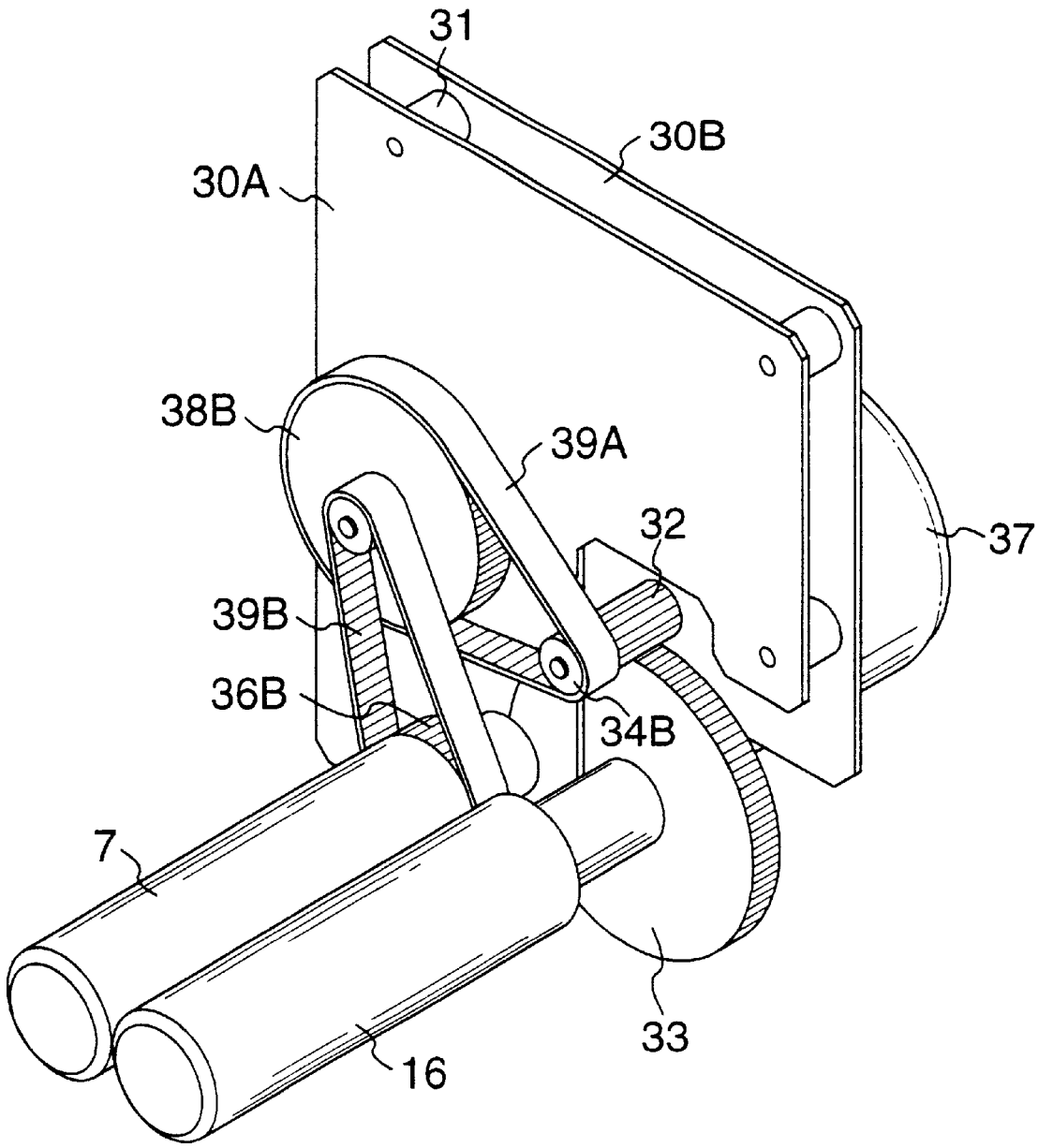
FIG. 2 is a perspective view showing a drive transmission mechanism composed of a photosensitive roller and a developing roller in the image forming apparatus shown in FIG. 1.
Figure 3:
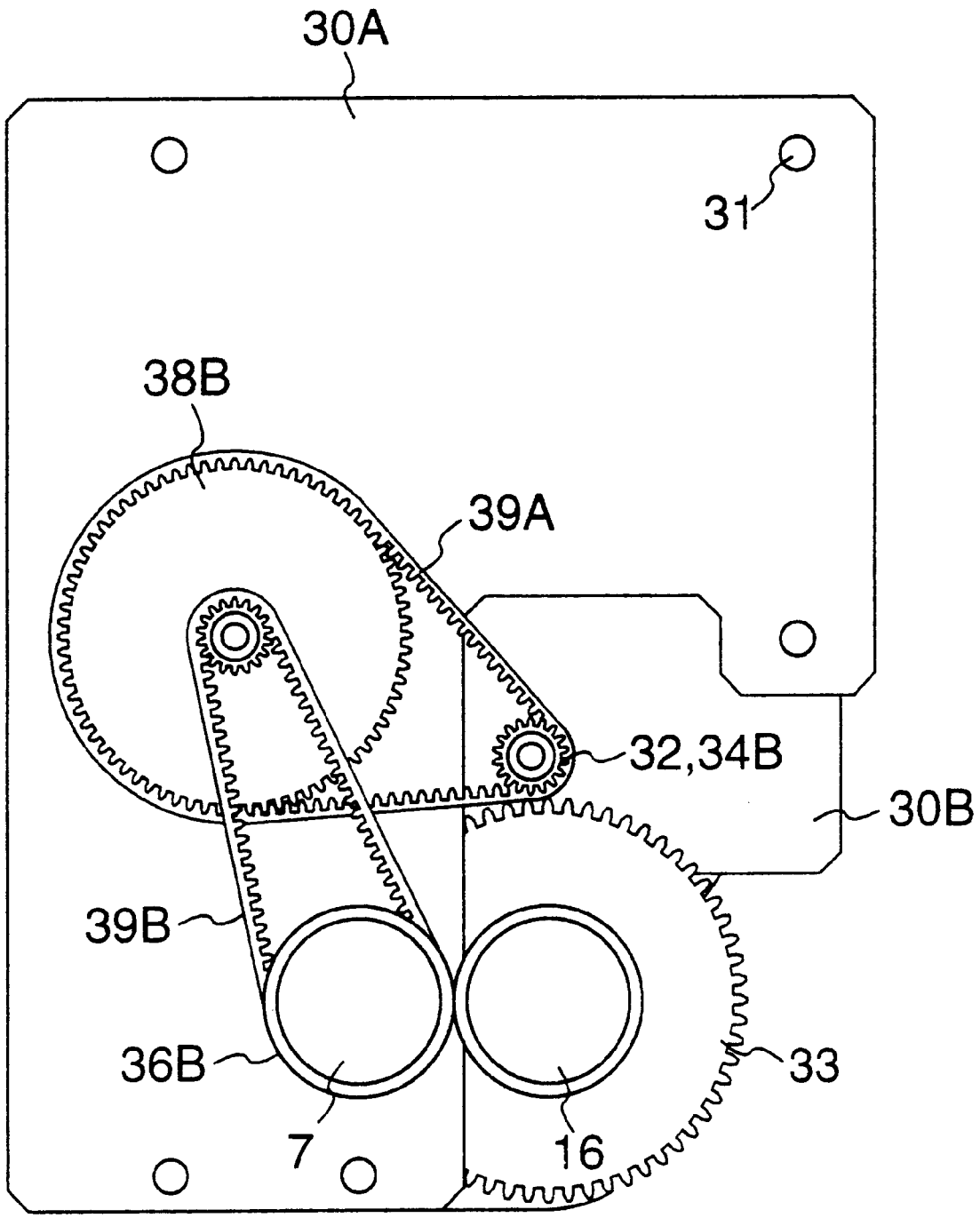
FIG. 3 is a front view showing the drive transmission mechanism composed of the photosensitive roller and the developing roller in the image forming apparatus shown in FIG. 1.
Figure 4:
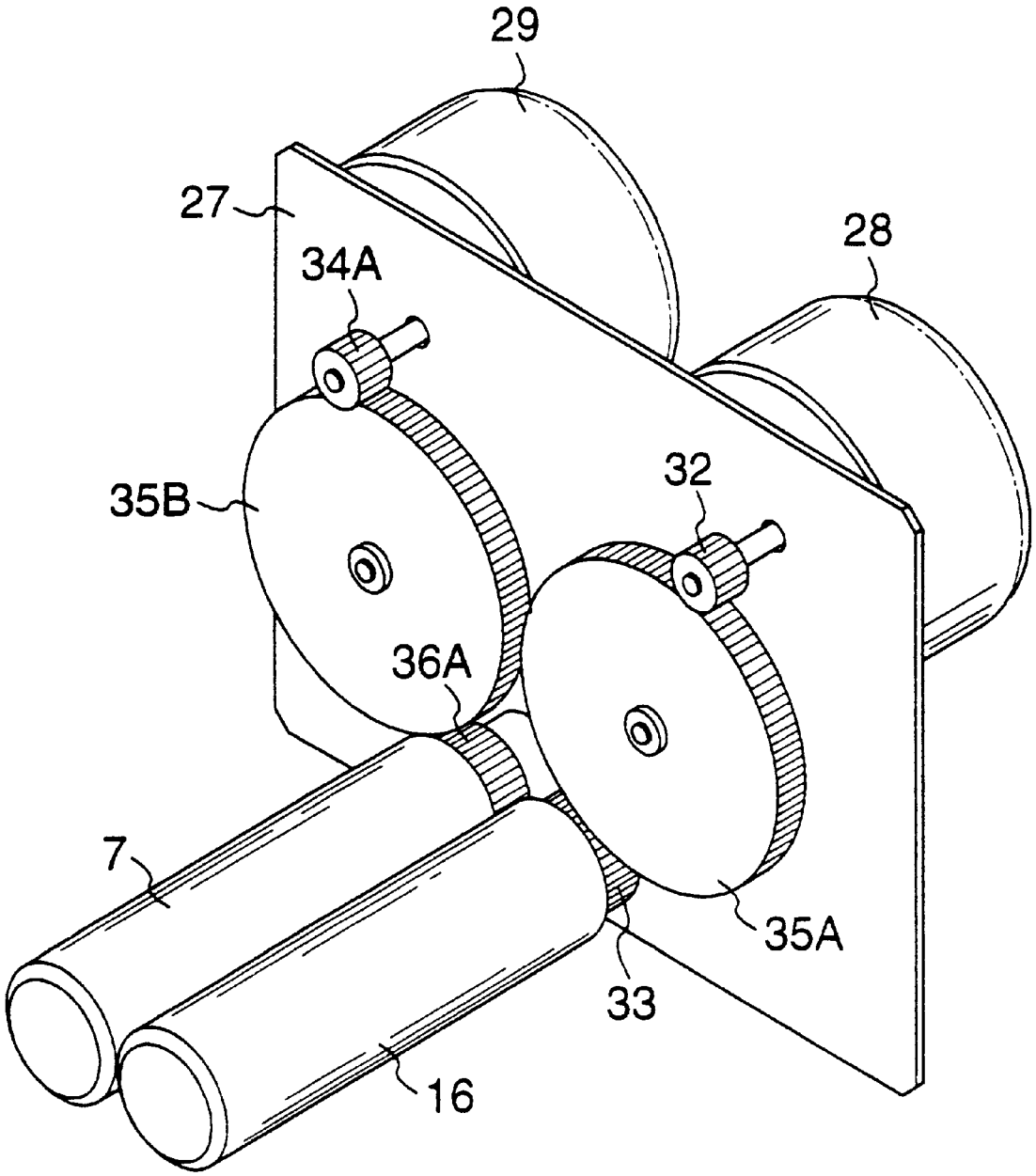
PRIOR ART FIG. 4
FIG. 4 is a perspective view showing an essential part of a conventional drive transmission mechanism composed of a photosensitive roller and a developing roller.
Figure 5:
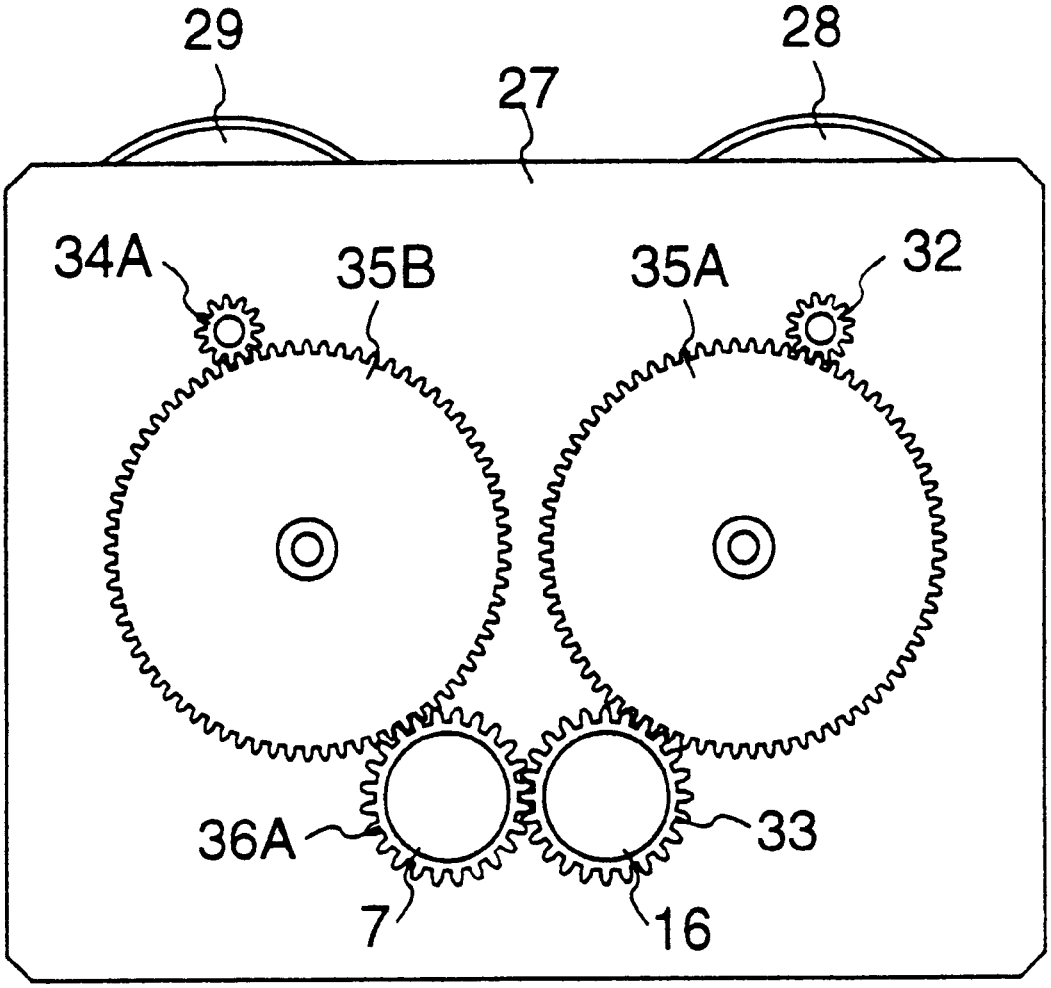
PRIOR ART FIG. 5
FIG. 5 is a front view showing the essential part of the conventional drive transmission mechanism composed of the photosensitive roller and the developing roller.

An embodiment of the present invention will be described hereinbelow with reference to FIGS. 1 to 3. In addition, the same reference numerals designate the same parts in these drawings, and duplication in description is omitted.

Figure 1:
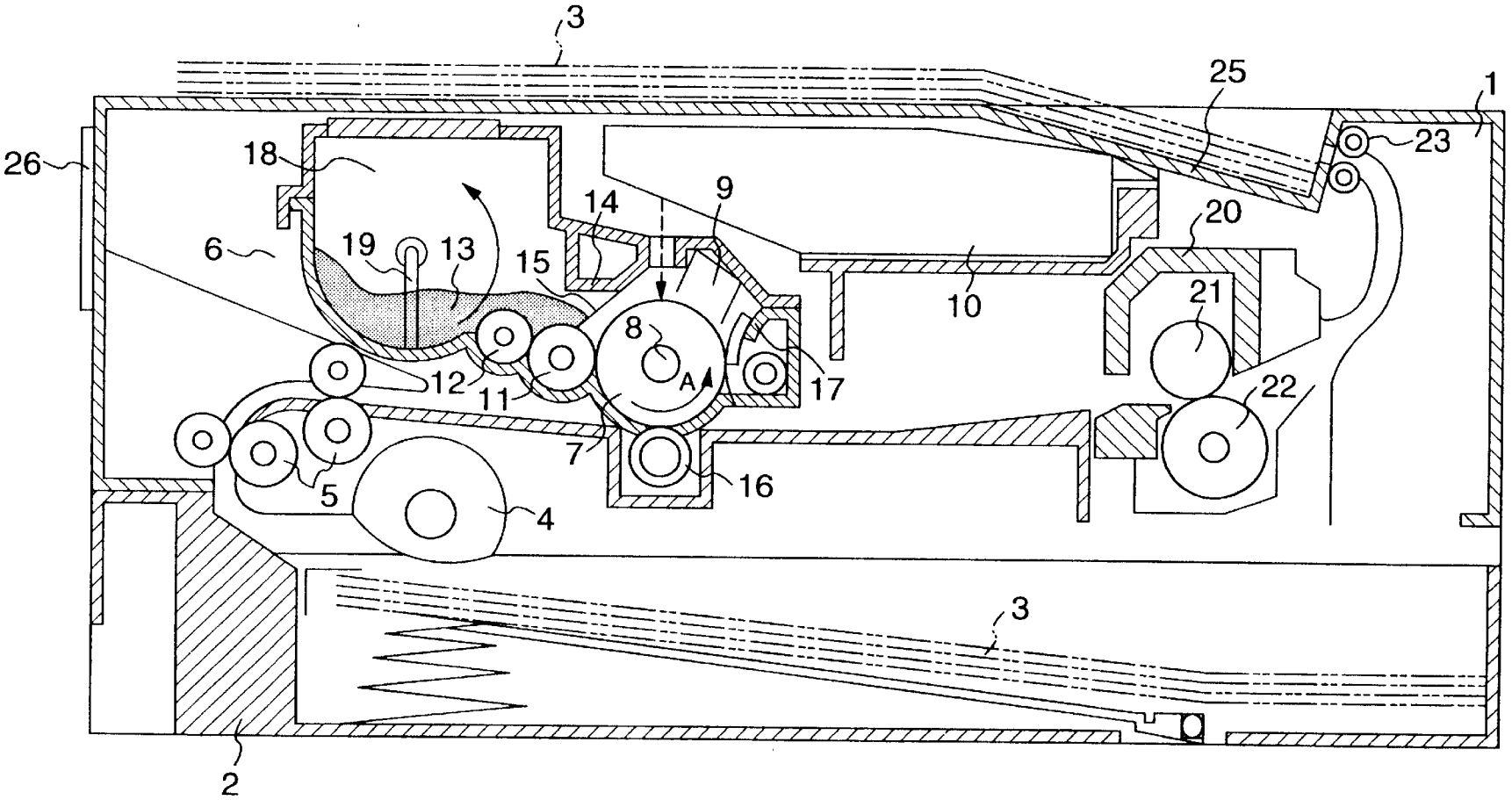
FIG. 1 is a schematic diagram showing a construction of an image forming apparatus according to a first embodiment of the present invention.

FIG. 1 is a schematic diagram showing a construction of an image forming apparatus according to a first embodiment of the present invention. FIG. 2 is a perspective view showing a drive transmission mechanism composed of a photosensitive roller and a developing roller in the image forming apparatus shown in FIG. 1. FIG. 3 is a front view showing the drive transmission mechanism composed of the photosensitive roller and the developing roller in the image forming apparatus shown in FIG. 1.

As shown in FIG. 1, an apparatus body 1 is provided with a process unit 6, in which major parts for performing image formation are received integrally, and which is detachably mounted in the apparatus body 1 to facilitate replacement of consumable parts. A stationary shaft 8 is mounted on a side wall of the process unit 6. A photosensitive roller (first roller) 7 being an image carrying body is rotatably borne on the stationary shaft 8. The photosensitive roller 7 comprises a metallic drum of aluminum or the like having a thin-film electrode on a surface thereof, to which an organic photoconductive material is adhered.

An electrostatic charging device 9 is disposed in the vicinity of the photosensitive roller 7. The electrostatic charging device 9 is applied by high voltage from a high voltage power supply to uniformly electrify a surface of the photosensitive roller 7 along a direction of rotation (a counterclockwise direction shown by the arrow A in the drawing) of the photosensitive roller 7.

The image forming apparatus is provided with a laser scanning unit (hereinafter, referred to as "LSU") 10. The LSU 10 comprises a lens and a polygon mirror for scanning a semiconductor laser beam, and forms an electrostatic latent image by irradiating a laser beam onto the photosensitive roller 7 which is uniformly electrified with image data being optically modulated.

Further, a developing unit for developing the electrostatic latent image formed on the photosensitive roller 7 is formed near the photosensitive roller 7. The developing unit comprises an agitator 19 for conveying toner 13 to a supply roller 12 while revolving and agitating the toner 13 in a toner reservior 18, and a developing roller (second roller) 11 that is rotatably borne on a side wall of the process unit 6 and supplies the toner 13, which is supplied by the supply roller 12, to the electrostatic latent image on the photosensitive roller 7 for development. Negative potential is applied to the developing roller 11, whereby negative charges are given beforehand to the toner 13 supplied. In addition, a developing blade 15 for frictionally electrifying the toner 13, supplied to the developing roller 11, in a configuration of a uniform thin layer with a biasing force is secured to a blade-mounting plate 14 which bridges across side walls of the process unit 6.

In addition, the developing roller 11 supplies the toner 13 to the photosensitive roller 7 whereby the toner 13 adheres to the electrostatic latent image, from which charges are extinguished by irradiation of a laser beam, so that negative-positive development is performed to form a toner image.

As shown in the drawing, a paper cassette 2 is provided in a bottom section of the image forming apparatus. Sheets of paper (printing media) 3 are contained in the paper cassette 2, and are taken out one by one by a paper supply roller 4 to be conveyed in a conveyance path. Provided along and on the conveyance path in the direction of conveyance are a plurality of conveyance rollers 5 for conveying a sheet of paper 3 taken out by the paper supply roller 4 to a printing unit downstream in the direction of conveyance, and a transfer roller 16 adapted to contact with the photosensitive roller 7 to rotate. The transfer roller 16 is rotatably borne by the apparatus body 1 to be pressed against the photosensitive roller 7, so that upon application of high voltage, the biasing force of the transfer roller 16 causes the toner image developed on a surface of the photosensitive roller 7 to be transferred to the sheet of paper 3.

A cleaning blade 17 is provided for removing the toner 13 remaining on the surface of the photosensitive roller 7 after the transfer roller 16 transfers the toner image onto the sheet of paper 3.

A fixing device 20 is provided on the conveyance path backward the transfer roller 16. The fixing device 20 comprises a heat roller 21 having a heat source such as a halogen lamp or the like, and a pressure roller 22 adapted to rotate in contact with the heat roller 21. Further, the toner image transferred is fixed to the sheet of paper 3 while the sheet of paper 3 is interposed between and fed by the heat roller 21 and pressure roller 22 which rotate.

Provided at a terminal end of the conveyance path are paper ejection rollers 23 for ejecting the sheet of paper 3 from the fixing device 20 to the outside of the apparatus, and an ejected-paper tray 25. Thus, the sheet of paper 3, on which the toner image has been transferred and fixed, is fed to the paper ejection rollers 23 to be ejected to the ejected-paper tray 25.

In addition, a display unit 26 informing a user about apparatus information is provided in front of the apparatus body 1.

Next, the printing action of the image forming apparatus constructed in the above manner will be described.

In the image forming apparatus, a CPU revolves a motor according to the printing request from a host computer, and performs control in an electrostatic charging step, an exposure step, a developing step, a transfer step, a fixing step and the like.

First, in the electrostatic charging step, high DC voltage is applied to a wire in the electrostatic charging device 9 to effect corona discharge so as to generate, for example, about −700 V of voltage in a grid plate to uniformly electrify the surface of the photosensitive roller 7, rotating in the direction shown by the arrow A, at about −700 V.

Next, in the exposure step, a laser beam radiated from the LSU 10 is modulated according to data of characters and image patterns transmitted from an image processing unit, and the laser beam is irradiated on the surface of the photosensitive roller 7. Since a portion of the photosensitive roller irradiated with the laser beam increases in electric conductivity, only the charges in the part are extinguished and an electrostatic latent image is accordingly formed.

In the developing step, a developing unit electrifies the toner 13 at, for example, around −300 V. Therefore, the toner 13 adheres to the surface portion of the photosensitive roller 7, on which the electrostatic latent image is formed, and negative-positive development is performed.

In the transfer step, the sheet of paper 3 is taken out from the paper cassette 2 by the paper supply roller 4 to be conveyed on the conveyance path by conveyance rollers 5. Furthermore, the toner 13 adhering to the surface of the photosensitive roller 7 is transferred to the sheet of paper 3 by an electrostatic Coulomb's force of the transfer roller 16, to a surface of which, for example, about +1000 V of voltage is applied.

In the final fixing step, the toner image transferred is fixed on the sheet of paper 3 by the pinch pressure of the pressure roller 22 in the fixing device 20 and heat generated from the heat roller 21. Furthermore, the sheet of paper 3 passes on the conveyance path to be ejected to the ejected-paper tray 25 by the paper ejection roller 23.

Here, a drive transmission mechanism composed of the photosensitive roller and the developing roller will be described with reference to FIGS. 2 and 3.

As shown in the drawings, a first plate 30A and a second plate 30B disposed in parallel to and spaced a predetermined spacing from each other by a plurality of supports 31 are provided in the drive transmission mechanism. Further, a common motor (motor) 37 is mounted on the second plate 30B.

The rotating shaft of the common motor 37 extends through a hole formed in the second plate 30B to project from a cut portion of the first plate 30A, and mounts thereon a developing motor gear (motor gear) 32 and a photoreceptor motor pulley (motor pulley) 34B, which are arranged on and toward an end of the rotating shaft in this order.

In addition, a developing roller driving gear (roller driving gear) 33 engaging with the developing motor gear 32 described above is rotatably mounted on the second plate 30B. A developing roller 16 is connected to the developing roller driving gear 33, which is located between the first and second plates 30A and 30B, through a transmission-connecting device.

Further, a stepped pulley (transit pulley) 38B and a photoreceptor driving pulley (driving pulley) 36B are rotatably mounted on the first plate 30A. Moreover, a photosensitive roller 7 is connected to the photoreceptor driving pulley 36B through a transmission-connecting device. Here, as shown in the drawings, a belt (first belt) 39A made of rubber and the like having flexibility and formed at an inner circumference thereof with teeth is trained round the photoreceptor motor pulley 34B and a larger-diameter pulley of the stepped pulley 38B. Also, a belt (second belt) 39B made of rubber and the like having flexibility and formed at an inner circumference thereof with teeth is also trained round a smaller-diameter pulley on the stepped pulley 38B and the photoreceptor driving pulley 36B.

Thus torque of the common motor 37 is transmitted to the developing roller driving gear 33, which engages with developing motor gear 32 fixed to the rotating shaft of the common 37, so that the developing roller 16 connected to the developing roller driving gear 33 is rotated. At the same time, torque of the common motor 37 is transmitted from the photoreceptor motor pulley 34B, which is similarly fixed to the rotating shaft of the common motor 37, through the belt 39A to the stepped pulley 38B, and is further transmitted from the stepped pulley 38B through the belt 39B to the photoreceptor driving pulley 36B. Thus the photosensitive roller 7 connected to the photoreceptor driving pulley 36B is rotated.

In this manner, according to this embodiment, the common motor 37 is provided to have two drive transmission means, that is, the developing motor gear 32 and photoreceptor motor pulley 34B fixed to the rotating shaft thereof, and torque of the common motor 37 is transmitted by the developing motor gear 32 and photoreceptor motor pulley 34B to the developing roller 16 and photosensitive roller 7, respectively. Therefore, it becomes possible to drive the developing roller 16 and photosensitive roller 7 with a single motor without the use of any intermediate gear. Accordingly, it is possible to achieve reduction in cost of the apparatus and to obtain an image of high quality attributed to non-use any intermediate gears.

In addition, according to this embodiment, torque of the common motor 37 taken out from the photoreceptor motor pulley 34B is transmitted to the stepped pulley 38B through the belt 39A, and further is transmitted to the photoreceptor driving pulley 36B through the belt 39B to rotate the photosensitive roller 7. Therefore, it is possible to drive the developing roller 16 and photosensitive roller 7 without the use of any intermediate gears. Thus it becomes possible to suppress generation of uneven rotation and to achieve space saving.

In addition, positions where the developing roller 16 and photosensitive roller 7 are mounted may be reversed relative to those in this embodiment. In this case, the developing roller 16 is rotatingly driven by the belts 39A and 39B.

Since the developing roller 16 requires a greater rotating torque than that for the photosensitive roller 7, positions where the developing roller 16 and photosensitive roller 7 are mounted in this embodiment are preferable in making it possible to reduce belts 39A and 39B in strength as compared with the case that such positions are reversed. As described above, according to the present invention, there is obtained an advantage that it is possible to drive the two rollers composed of a developing roller and a photosensitive roller with a single motor because two drive transmission means including a motor gear and a motor pulley are fixed to a rotating shaft of a motor, and torque of the motor is transmitted to the two rollers by the motor gear and motor pulley.

Accordingly, there is obtained an advantageous effect that it is possible to achieve reduction in cost of the apparatus.

In addition, according to the present invention, torque of the motor taken out from the motor pulley is transmitted to an intermediate pulley through the first belt, and further is transmitted to a driving pulley through the second belt to rotate the roller. Therefore, there is obtained an advantageous effect that it is possible to drive the two rollers including the developing roller and photosensitive roller without the use of any intermediate gears.

Accordingly, there is obtained an advantageous effect that it is possible to suppress generation of uneven rotation and to achieve space saving.

What is claimed is:

1. An image forming apparatus comprising:

a motor for generating torque;

a second plate provided on a side of a rotating shaft of the motor and fixing thereto the motor;

a motor gear fixed to the rotating shaft;

a drive transmission member fixed to the rotating shaft to be nearer to a tip end of the rotating shaft than the motor gear is;

a first plate disposed between the motor gear and the drive transmission member to be in parallel to the second plate;

a second roller rotatably provided on the second plate;

a roller driving gear which engages with the motor gear and connects to the second roller, and which is larger in diameter than the second roller is;

a first roller rotatably provided on the first plate to be close to the second roller; and a drive receiving member, to which torque is transmitted from the drive transmission means and the first roller is connected.

2. An image forming apparatus comprising:

a motor for generating torque;

a second plate provided on a side of a rotating shaft of the motor to fix thereto the motor;

a motor gear fixed to the rotating shaft;

a motor pulley fixed to the rotating shaft to be nearer to a tip end of the rotating shaft than the motor gear is;

a first plate disposed between the motor gear and the motor pulley to be in parallel to the second plate;

a second roller rotatably provided on the second plate;

a roller driving gear which engages with the motor gear and connects to the second roller, and which is larger in diameter than the second roller is;

a first roller rotatably provided on the first plate to be close to the second roller; and a driving pulley, to which torque is transmitted from the motor pulley and the first roller is connected.

3. An image forming apparatus comprising:

a motor for generating torque;

a second plate provided on a side of a rotating shaft of the motor to fixe thereto the motor;

a motor gear fixed to the rotating shaft;

a motor pulley fixed to the rotating shaft to be nearer to a tip end of the rotating shaft than the motor gear is;

a first plate disposed between the motor gear and the motor pulley to be in parallel to the second plate;

a second roller rotatably provided on the second plate;

a roller driving gear which engages with the motor gear and connects to the second roller, and which is larger in diameter than the second roller is;

a first roller rotatably provided on the first plate to be close to the second roller;

a transit pulley, to which torque is transmitted from the motor pulley; and a driving pulley, to which torque is transmitted from the transit pulley and the first roller is connected.

4. The image forming apparatus according to claim 3, wherein the transit pulley is rotatably provided on the first plate.

* * * * *